United States Patent [19]

Nelson

[11] 4,122,898

[45] Oct. 31, 1978

[54] TUBING TESTER

[75] Inventor: Wayne F. Nelson, Wichita Falls, Tex.

[73] Assignee: The Dow Chemical Company, Midland, Mich.

[21] Appl. No.: 772,198

[22] Filed: Feb. 25, 1977

[51] Int. Cl.[2] ..... E21B 43/12

[52] U.S. Cl. ..... 166/325; 166/330; 166/332

[58] Field of Search ..... 166/325, 330, 332, 334; 175/241, 242

[56] References Cited

U.S. PATENT DOCUMENTS

| | | | |
|---|---|---|---|
| 2,853,265 | 9/1958 | Clark, Jr. | 166/331 |
| 2,874,927 | 2/1959 | Conrad | 166/334 |
| 3,338,312 | 8/1967 | Scott | 166/331 |
| 3,470,903 | 10/1969 | Scott | 166/325 |

*Primary Examiner*—Ernest R. Purser

*Assistant Examiner*—William F. Pate, III

*Attorney, Agent, or Firm*—Earl D. Ayers

[57] ABSTRACT

The invention is an elongated valved device adapted to be coupled between a string of tubing and a well bore packer.

An outer sleeve is coupled at one end to the tubing and has a movable hollow mandrel into the other end of the outer sleeve. Advancing or retracting of the mandrel is afforded by rotating the mandrel to engage grooves in the periphery of the mandrel with lugs at the end of the outer sleeve, then moving the mandrel axially with respect to the outer sleeve.

An inner sleeve is locked in position within the outer sleeve and has a spring loaded flapper valve assembly at its end facing the end of the mandrel.

Advancement of the mandrel forces its end (curved) through the valve assembly.

6 Claims, 7 Drawing Figures

TUBING TESTER

BACKGROUND OF THE INVENTION

This invention relates to valve apparatus which is useful in testing a string of tubing in a well bore.

In some earth well treatments very high pressures are applied to the string of tubing which is run into the well to the depth at which the treatment is to take place. A so-called tubing tester is attached between the bottom of the tubing string and a packer.

Periodically, as the tubing is lowered into the well casing, the tubing is pressurized to determine if it can withstand the treating pressure.

The tubing tester permits fluid to pass up the tubing as the tubing is lowered into the casing which is partially filled with fluid, permits a spring loaded flapper valve to close when pressure is applied to test the tubing, and positively opens the flapper valve when the pressurized well treatment begins.

OBJECTS OF THE INVENTION

A principal object of this invention is to provide an improved, re-usable tubing tester.

Another object of this invention is to provide an improved, easy to use tubing tester device.

A further object of this invention is to provide an improved, positive locking and unlocking valved tubing tester.

STATEMENT OF INVENTION

In accordance with this invention, there is provided an elongated tool comprising an outer sleeve, an inner sleeve containing a valve seat and flapper valve plus means to key the inner sleeve to the outer sleeve, a movable mandrel assembly utilizing J-slots in connection with internal lugs on the outer sleeve to advance or retract one end of the mandrel through the valve seat, and hold the mandrel in either position, plus an upper connector coupled to the end of the outer sleeve and a lower connector coupled to the end of the mandrel which is remote from the valve seat.

The curved and slotted upper end part of the mandrel is aligned with and cross sectionally dimensioned to pass through the valve seat.

With the mandrel in its lower position, fluid pressure in the casing may open the flapper valve, and fluid pressure applied to the tubing closes the valve to permit pressure testing of the tubing.

Once the tubing is at the desired position in the tubing and the packer is set, the tubing is rotated and the mandrel advanced through the valve seat, so well treatment fluid can be passed downwardly through the tubing tester.

BRIEF DESCRIPTION OF THE DRAWINGS

The invention will best be understood when the following detailed description is read in connection with the accompanying drawings, in which.

DETAILED DESCRIPTION OF THE DRAWINGS

Figure 1A:
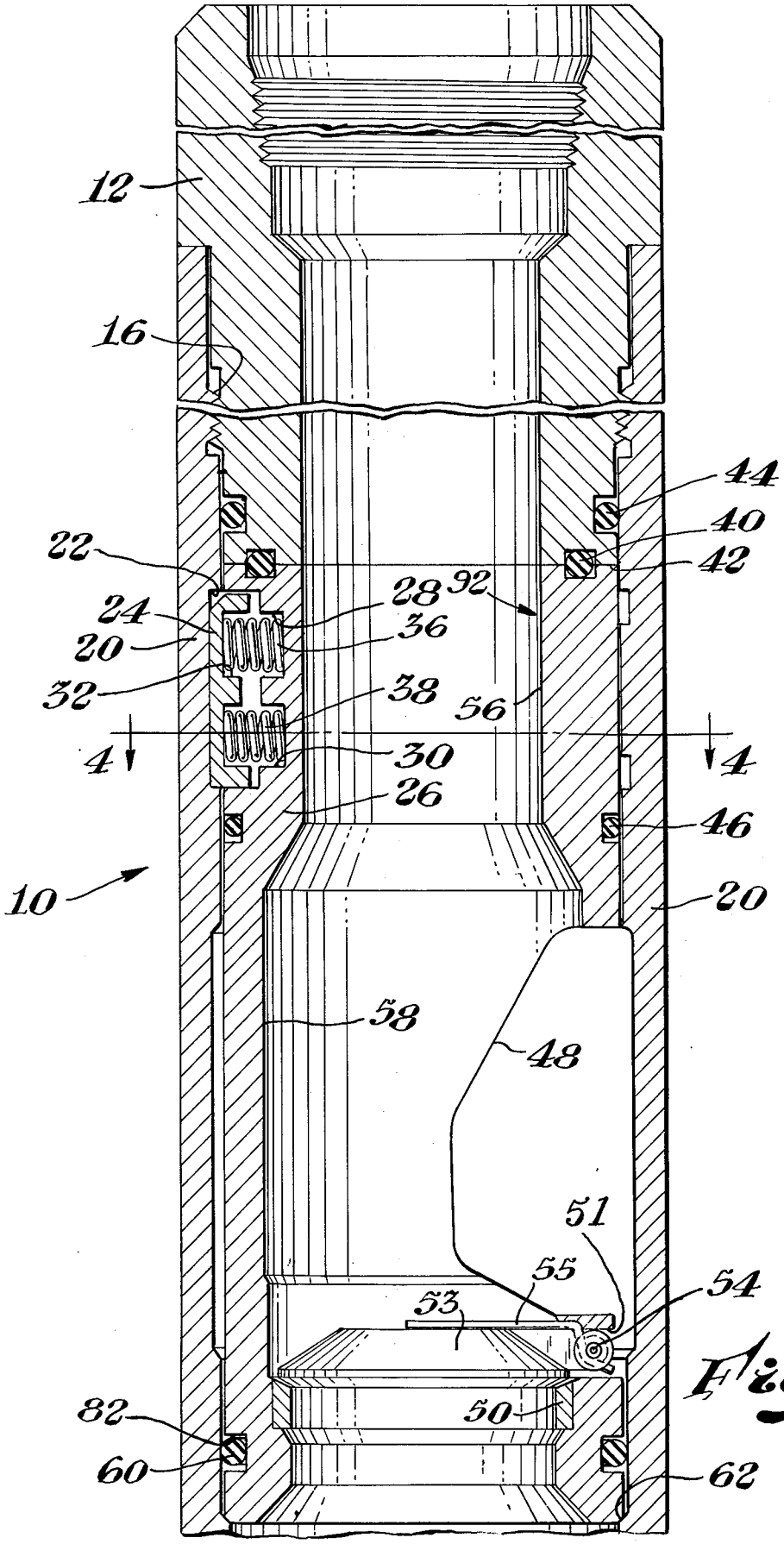
FIG. 1*a* and 1*b* each are partial front elevational views, in section, of a tubing tester in accordance with this invention.
Figure 1B:
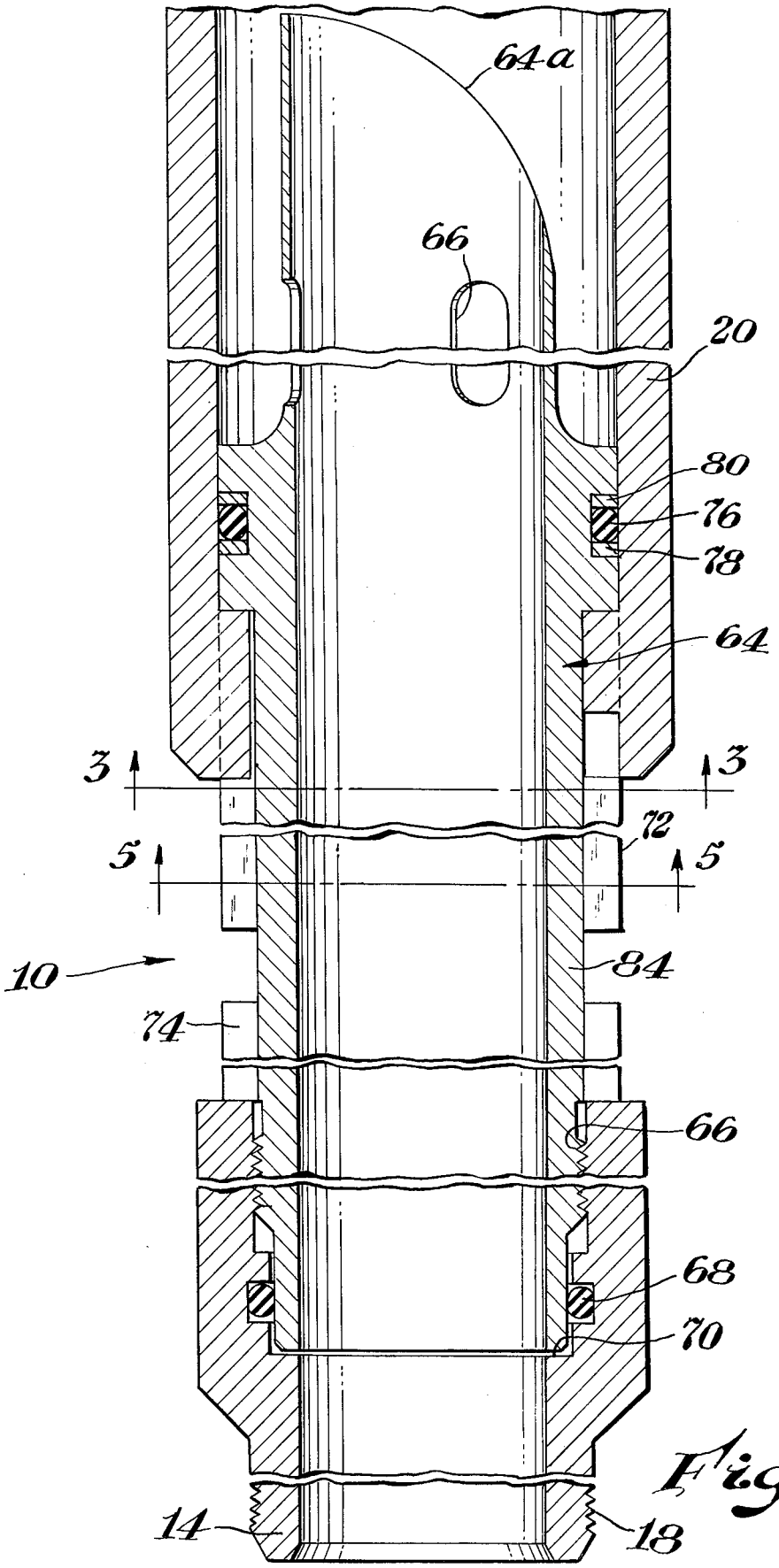

Referring to the drawings, and particularly to FIGS. 1A and 1B, there is shown tubing tester apparatus, indicated generally by the numeral 10, including an elongated outer sleeve 20 which has a tubing coupler 12 coupled to the internal threads 16 near the upper end of the sleeve 20.

A second coupler 14 having external threads 18 in its lower end part engages external coupling threads in the mandrel 64 at its upper end.

Seals 40, 44 and 68 prevent fluid passage between the coupler 12 and the interior of the outer sleeve 20 and mandrel 64, respectively.

Figure 2:
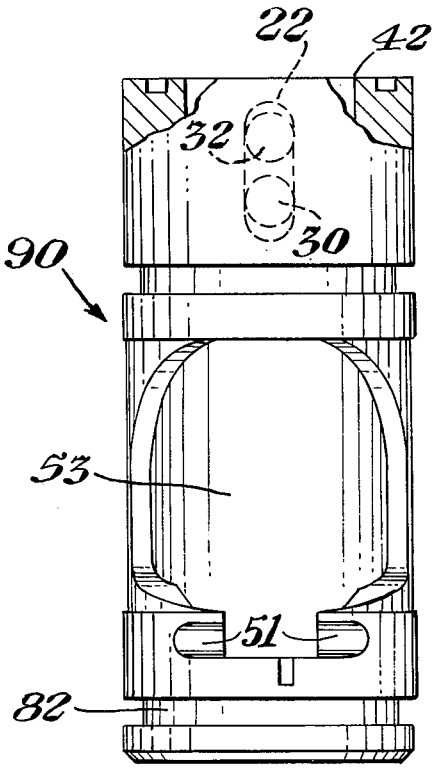
FIG. 2 is a side elevational view of the inner sleeve (including the flapper view) of the apparatus shown in FIG. 1.

Referring now to FIG. 2, as well as to FIG. 1, an inner sleeve, indicated generally by the numeral 90, is disposed within the outer sleeve 20 with its upper end 42 abutting against the inner end of the tubing coupler 12. A ring seal 40 is provided in grooves facing each other in the abutting ends of the coupler 12 and the inner sleeve 90.

The sleeve 90 has an inner wall surface 56 which is smaller than the diameter of the lower wall part 58. The wall part 58 has a cut out area 52 (defined by edge surface 48) which permits a valve flapper, when opened completely, to lie in the cut out area 52 out of the path of the fully advanced mandrel 64.

The lower end part of the inner sleeve 90 seats against the shoulder 62 in the inner wall of the outer sleeve 20.

A tubular valve insert 50 is disposed across the lower end part of the inner sleeve 90.

A spring loaded valve flapper 53 is seated against the seat of the valve insert 50 and is pivotally coupled, as at 54 in the groove 51 in the side wall of the inner sleeve 90 whereby the flapper 53 may be pivoted upwardly and into the cutout area 52 defined by the edge surface 48 the spring loading of the flapper 53 is achieved by means of a spring 55 coiled around the double ended pivot 54 which sits in the transverse groove 51. One end of spring fits against the top of the flapper 53 and the other end of the spring fits into the slot 51*a* (see FIG. 2). As may be seen in FIG. 1A, the wall 20 and structure of groove 51 allows some freedom movement in the groove 51 of the pivotal part 54 as the flapper 53 is raised.

Seals 60 and 46, disposed in peripheral grooves in the outer wall of the inner sleeve, prevent the passage of fluid around the valve 50 from below or between the inner wall of the outer sleeve and outer wall of the inner sleeve, respectively.

Radial movement of the inner sleeve 90 is prevented by the key 24 which fits into slot 22 in the inner wall of the outer sleeve 20. The key 24 is held in position by springs 36, 38 which are disposed in bores 28 and 30 in the inner sleeve and within pockets 32, 34 in the key 24.

FIG. 1B illustrates the lower end part of the outer sleeve 20 with the mandrel 64 extending into the outer sleeve with its curved upper end disposed just below and in axial alignment with the valve insert 50.

An array of slots 66 extends through the wall of the smaller diameter upper end part of the mandrel. The remainder of the mandrel has an outer diameter which fits closely but slidably within the inner wall of the outer sleeve 20.

Figure 3:
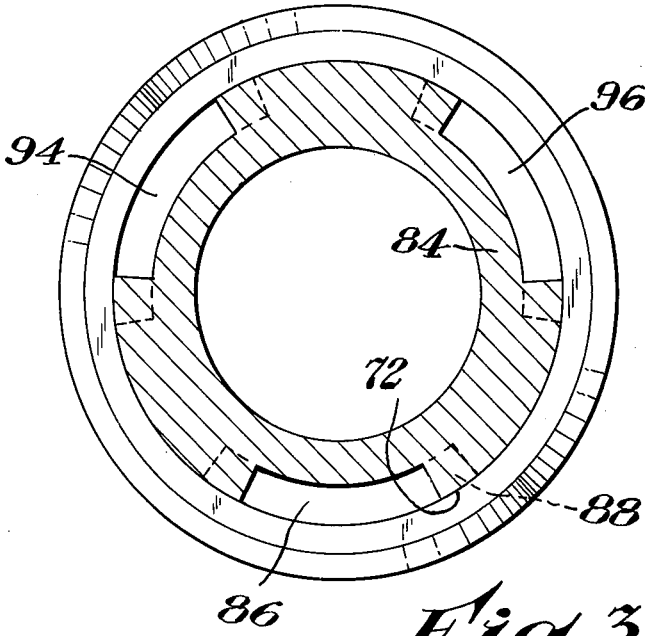
FIG. 3 is a sectional view taken along the line 3—3 of FIG. 1.
Figure 4:
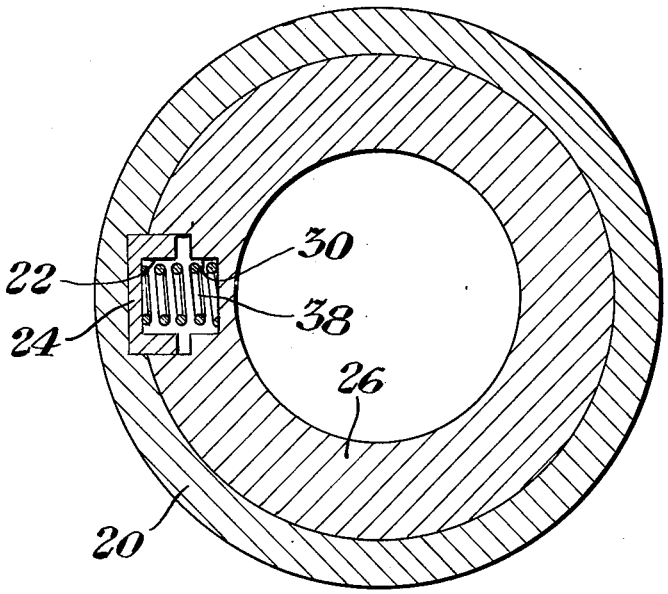
FIG. 4 is a sectional view taken along the line 4—4 of FIG. 1.
Figure 5:
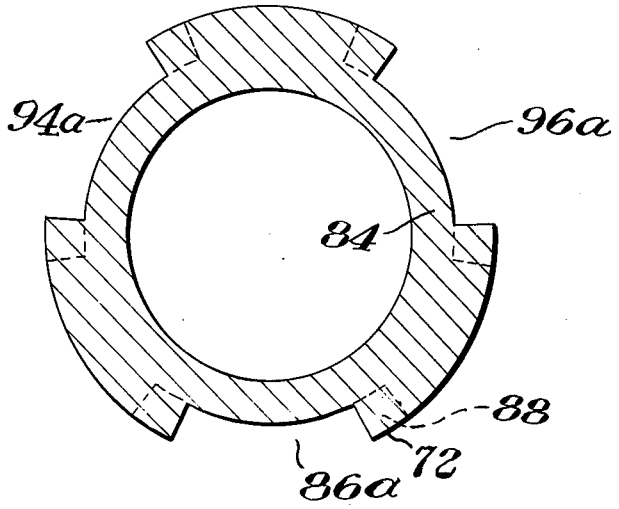
FIG. 5 is a sectional view taken along the line 5—5 of FIG. 1.
Figure 6:
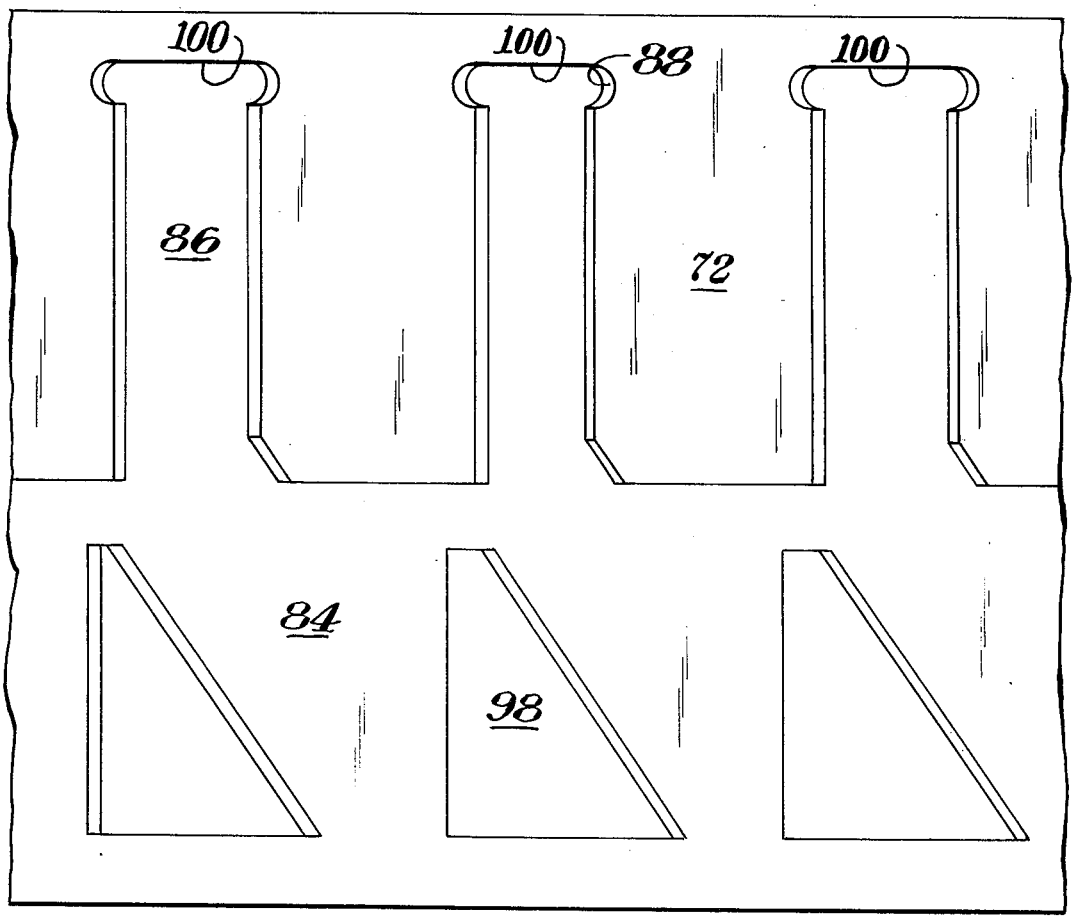
FIG. 6 is a developmental view of the lower end of the mandrel of FIG. 1.

The lower end of the outer sleeve 20 contains lugs 86, 94, 96 (See FIG. 3) around which pass grooves 86*a*, 94*a* and 96*a* shown in FIG. 5 in the outer surface 72 of the larger diameter part of the mandrel. One of the lugs and grooves is of different size than the others to insure proper rotational alignment of the curved end 64*a* of the mandrel with respect of flapper 53. That is, the end of the mandrel is aligned with the side of the flapper 53 which is remote from the hinged part of the valve.

Each of the elongated grooves 86*a*, 94*a* 96*a* have enlarged end parts 88 which extend laterally from each side of each groove.

The rear end grooved part 84 of the mandrel constitutes the space between the triangularly shaped raised parts 98 which, with the grooves 86*a*, 94*a* and 96*a* constitute a J-slot array as is well-known in the well tool art.

The seals 76, 78, 80 in the large diameter part of the mandrel 64 adjacent to the smaller diameter slotted part thereof prevents passage of material between the mandrel and the inner sleeve during a well treatment.

OPERATION

The tool is assembled by inserting the mandrel 64 through the upper end of the outer sleeve 20, lowering the mandrel until the J-slots pass through the lugs 86, 94, 96 in the lower end of the outer sleeve 20 until the shoulder 100 of the mandrel seats against the lugs 86, 94, 96.

The inner sleeve 92 is then inserted from the top of the outer sleeve 20 until it seats against shoulder 62 and is rotated until the key 24 fits into the slot 22 in the inner wall of the outer sleeve 20. The end couplers 12, 14 are then secured to the upper end of the outer sleeve 20 and the lower end of the mandrel 64 respectively.

The tubing tester 10 is then attached at its mandrel end to a packer (not shown) and at its upper end to a string of tubing (not shown).

As the tubing tester 10 is lowered through the fluid in the well, the fluid pressure form below the tester may overcome the pressure exerted by spring means 55 on the flapper valve 53 and permit fluid to open the flapper 53 to permit fluid to pass up the tubing string.

Pressurizing the tubing causes the flapper valve 53 to close, permitting checking the tubing to determine if it can withstand expected treating pressures. The tubing may be checked frequently as it is lowered into the well.

Once the packer is at the right depth in the well, the tubing is rotated and lowered with the J-slots aligned to advance the curved end 64*a* of the mandrel 64 upwardly through the flapper valve 53, forcing the valve 53 into the space 52 in the cut out side wall part of the inner sleeve 92.

The treatment fluid (not shown) may then be pumped through the tubing tester and packer and into the treating zone of the well.

What is claimed is:

1. Tubing tester apparatus comprising:

(a) an elongated generally cylindrical outer sleeve having inner and outer side walls, and upper and lower ends, means adjacent to said upper end for coupling a connector member, lug means adjacent to said lower end for receiving a J-slot of an axially movable mandrel;

(b) an elongated mandrel having a rounded upper end part, a cylindrical middle part dimensioned to fit closely but slidably against the inner side wall of said outer sleeve, said mandrel having a generally axially disposed elongated grooved lower part adapted to move between said lugs in said outer sleeve, and a lower end part adapted to receive a coupling member;

(c) an inner sleeve having inner and outer side walls, an upper end part and a lower end part, said lower end containing a flapper valve assembly disposed across said lower end part, said valve assembly including a valve seat structure having an axial aperture larger than the rounded upper end part of said mandrel and in axial alignment therewith and a spring loaded flapper having a double ended pivot part at one side, said pivot part being disposed in a transversely disposed grooved part of said lower end part, said spring loading including a spring coiled around said pivot of said flapper, said spring having one end bearing against the top of said flapper and a second end extending towards the top of said valve seat structure, said side walls having a cut out part adjacent to said flapper whereby when said flapper is fully open it partially fits into said cut out part, said outer sleeve having a shoulder along its inner wall against which said lower end of said inner sleeve abuts;

(d) a connector member, said connector member being coupled to said outer sleeve and having an end which abuts against said inner sleeve, and (e) a coupling member coupled to the lower end part of said mandrel and abutting against said grooved part.

2. Apparatus in accordance with claim 1, wherein a key slot is disposed in said inner side wall of said outer sleeve and a key element in said outer side wall of said inner sleeve is partially disposed in said key slot.

3. Apparatus in accordance with claim 2, wherein said key element is spring loaded.

4. Apparatus in accordance with claim 2, wherein said rounded upper end part of said mandrel has slots extending between said inner and outer side walls.

5. Apparatus in accordance with claim 1, wherein seals are provided between said mandrel and said outer sleeve and between said inner sleeve and said outer sleeve.

6. Apparatus in accordance with claim 1, wherein the most forward extending part of said mandrel is aligned with the part of said flapper which is remote from said pivot.

* * * * *